United States Patent [19]

Katoh et al.

[11] Patent Number: 4,502,424

[45] Date of Patent: Mar. 5, 1985

[54] BLOW-BY GAS RECOVERING SYSTEM FOR INTERNAL COMBUSTION ENGINES

[75] Inventors: Hisashi Katoh, Tokyo; Hiroshi Shinagawa; Keiji Miura, both of Saitama, all of Japan

[73] Assignee: Honda Giken Kogyo Kabushiki Kaisha, Tokyo, Japan

[21] Appl. No.: 545,904

[22] Filed: Oct. 27, 1983

[30] Foreign Application Priority Data

Nov. 24, 1982 [JP] Japan ..... 57-205826

[51] Int. Cl.[3] ..... F02F 9/02

[52] U.S. Cl. ..... 123/41.86; 123/196 R; 123/572; 123/573

[58] Field of Search ..... 123/572, 573, 574, 41.86, 123/196 R, 90.38; 55/419

[56] References Cited

U.S. PATENT DOCUMENTS

| | | | |
|---|---|---|---|
| 3,754,538 | 8/1973 | Ephraim, Jr. et al. | 123/41.86 |
| 3,769,798 | 11/1973 | Whittaker | 123/572 |
| 4,404,936 | 9/1983 | Tatebe et al. | 123/196 R |

FOREIGN PATENT DOCUMENTS

| | | | |
|---|---|---|---|
| 112056 | 12/1940 | Australia | 123/574 |
| 375975 | 10/1939 | Italy | 123/573 |
| 46-1208 | of 1971 | Japan | 123/574 |
| 125307 | 9/1980 | Japan | 123/574 |

*Primary Examiner*—E. Rollins Cross

*Attorney, Agent, or Firm*—Lyon & Lyon

[57] ABSTRACT

A blow-by gas recovering system for an internal combustion engine has two blow-by gas outlets spaced longitudinally of the crankshaft and each communicating with the crank chamber. Both outlets also communicate with a chamber for separating blow-by gas from lubricating oil. Blow by gas from the separating chamber is introduced into the engine intake system.

4 Claims, 3 Drawing Figures

BLOW-BY GAS RECOVERING SYSTEM FOR INTERNAL COMBUSTION ENGINES

The present invention relates to a blow-by gas recovering system for an internal combustion engine.

In an internal combustion engine, generally speaking, the crankcase is equipped with a system for recovering blow-by gases which have been blown through the clearance between the cylinder and the piston into the crankcase. The recovered gases are then fed into the engine intake system. In the prior art, however, since the outlet port for the blow-by gases is disposed at only one position of the crankcase, the blow-by gas recovering system may fail to perform the blow-by gas recovering function. This failure may occur when the internal combustion engine is tilted so that the oil level in the oil pan is inclined with respect to the engine body.

An object of the present invention is to provide a blow-by gas recovering system for an internal combustion engine, which is able to perform the blow-by gas recovering function, even if the engine is tilted.

Other objects and advantages will appear hereinafter.

Figure 1:
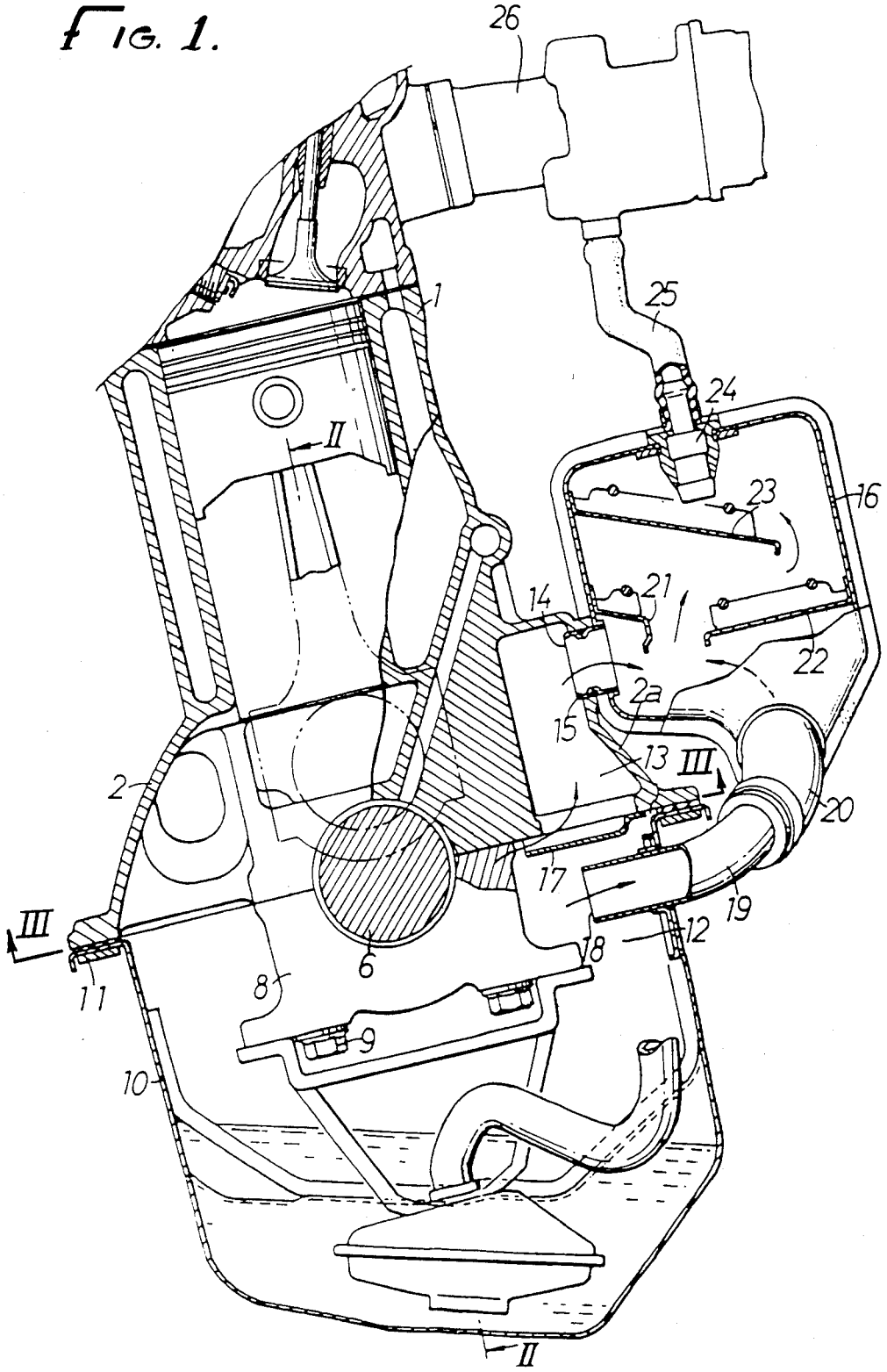
FIG. 1 is a sectional end elevation partly broken away, showing a preferred embodiment of this invention.
Figure 2:
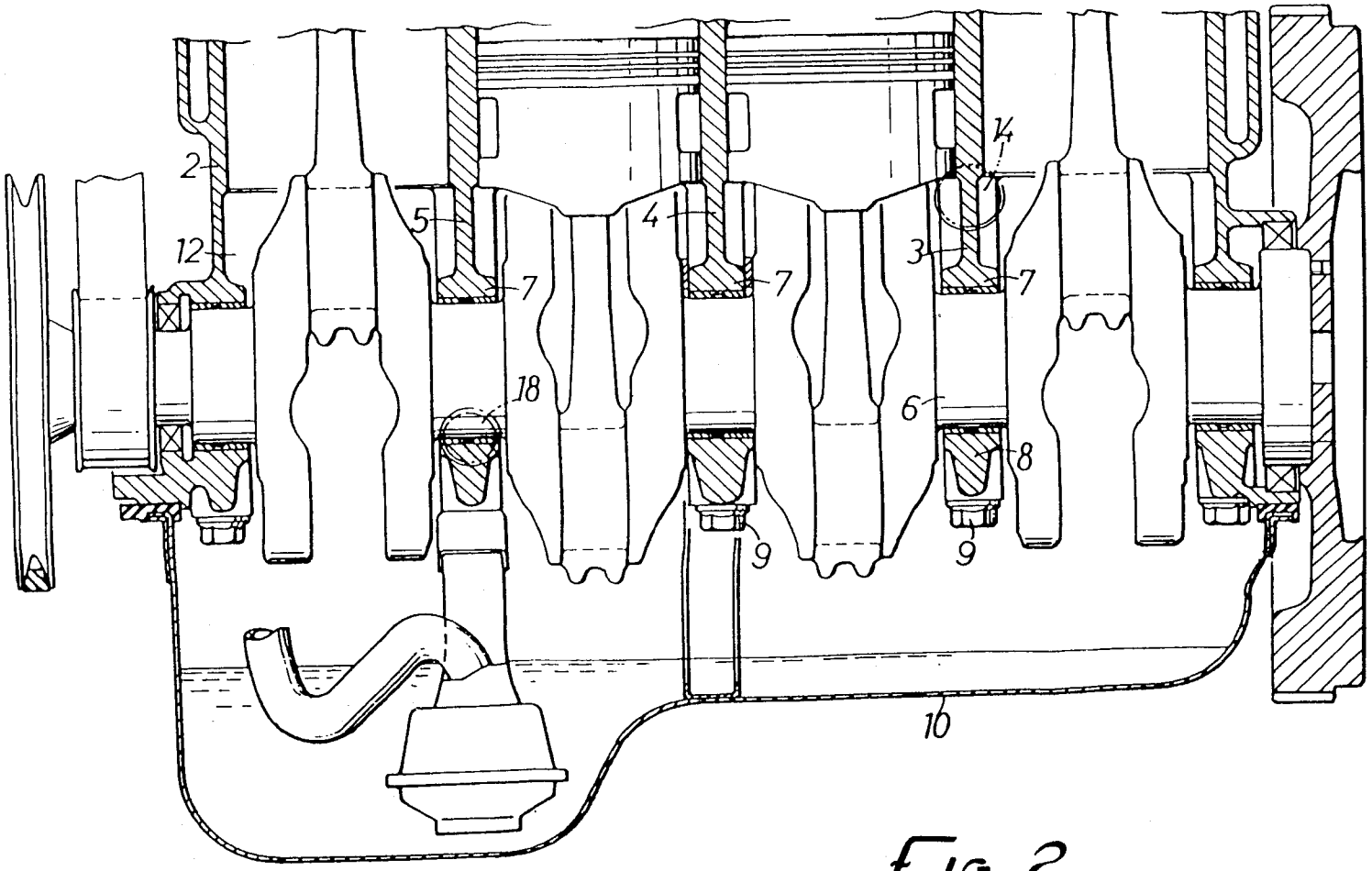
FIG. 2 is a sectional side elevation thereof.
Figure 3:
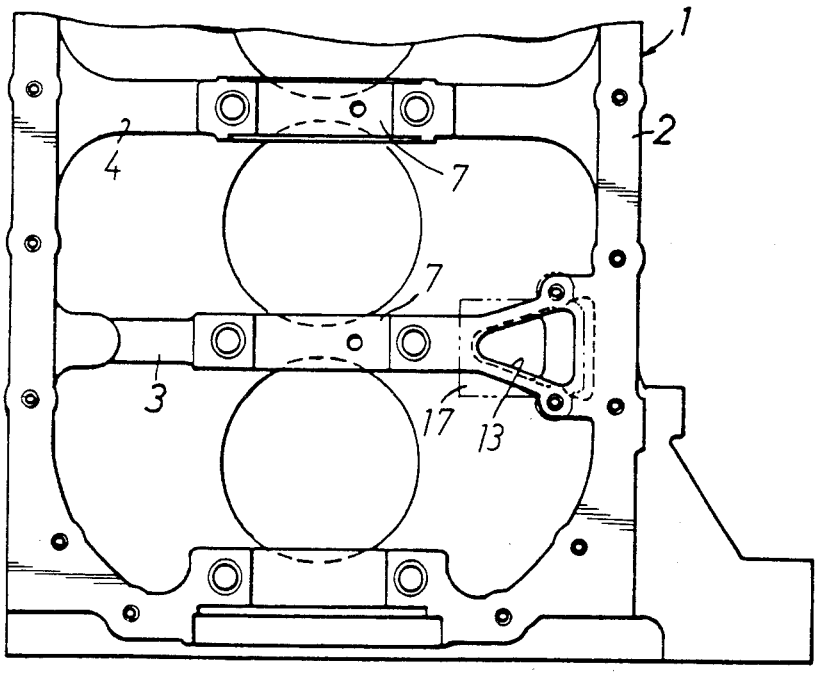
FIG. 3 is a view partly broken away and taken substantially on the lines 3—3 as shown on FIG. 1.

Referring to the drawings, a crankcase 2 is integrally formed in the lower portion of the cylinder block 1 of a four-cylinder internal combustion engine. The crankcase 2 is formed integrally with a plurality of crank journal walls 3, 4 and 5 which are spaced longitudinally of the crankshaft 6 and extend across the inside of the crankcase 2. The central portions of the crank journal walls 3, 4, 5 are formed with semicircular bearings upper halves 7 for bearing the upper half of the crankshaft 6. To the lower portions of the respective bearing upper halves 7, there are secured by means of fastening bolts 9 a plurality of bearing lower halves 8 for bearing the lower half of the crankshaft 6. To the lower face of the crankcase 2 there is secured by means of bolted flanges 11 an oil pan 10, containing lubricating oil.

One crank journal wall 3, which is adjacent to one end wall of the cylinder block 1, has a portion formed with a passage 13 having a lower end communicating with the crank chamber 12. Also, there is opened in the side wall 2*a* of the crankcase 2 a blow-by gas outlet port 14 which communicates with the lower end of the passage 13 while crossing the same at a right angle. The blow-by gas outlet port 14 discharges into a separating chamber 16. A baffle 17 is secured to the cylinder block 1 so that the oil splash in the crank chamber 12 can be prevented as much as possible from entering into the passage 13.

At a position which is spaced along the crankshaft 6 from the crank journal wall corresponding to the aforementioned blow-by gas outlet port 14, there is inserted an outlet pipe 19 which has its blow-by gas outlet port 18 facing the crank journal wall 5. This pipe 19 extends into the oil pan 10, and is connected through pipe 20 to the separating chamber 16. As a result, the two blow-by gas outlet ports 14 and 18 are formed in the crankcase 2 and the oil pan 10, respectively, at vertically different positions corresponding to the two crank journal walls 3 and 5 adjacent to the crank journal wall 4.

Within the separating chamber 16 there are arranged a plurality of baffles 21, 22 and 23 which operate to change the flow direction of the blow-by gas, and thereby separate the oil splash therefrom. By the actions of those baffles 21 to 23, the oil splash carried by the blow-by gas can be separated. To the upper portion of the separating chamber 16 there is connected through a pressure regulating valve 24 a connecting pipe 25, which in turn is connected to the engine intake system 26. As a result, both the blow-by gas outlet ports 14 and 18 are commonly connected to the intake system through the separating chamber 16.

In operation, the unburned gas in the combustion chamber blows through the clearance between the cylinder and the piston into the crank chamber 12. It is stored as blow-by gas in the crank chamber 12 until it is recirculated into the intake system by way of the paired blow-by gas outlet ports 14 and 18. Here, let it be assumed that the oil level in the oil pan 10 is inclined as a result of the tilted position of the internal combustion. In this case, according to the prior art, the outlet port is blocked by the oil so that the blow-by gas recovering function is adversely affected. According to the present invention, however, the blow-by gas outlet ports 14 and 18 are arranged to correspond to the paired crank journal walls 3 and 4, and interposing therein the crank journal wall 5 so that the blow-by gas can be removed from either of the outlet ports even if the oil level is inclined.

As above described, according to the present invention, the crankcase or the oil pan outlet ports are formed at the two positions, which are spaced from each other along the crankshaft of the engine, and connect with the engine intake system. As a result, the blow-by gas can be recovered from either of the blow-by gas outlet ports even if the internal combustion engine is tilted.

Having fully described our invention, it is to be understood that we are not to be limited to the details herein set forth but that our invention is of the full scope of the appended claims.

We claim:

1. A blow-by gas recovering system for an internal combustion engine, the engine having a crankshaft and having a pan for lubricating oil secured below a crankcase to define a crank chamber, the improvement comprising, in combination: a first blow-by gas outlet communicating with said crank chamber, a second blow-by gas outlet communicating with said crank chamber, said blow-by gas outlets being spaced longitudinally of the engine crankshaft, a separating chamber for separating blow-by gas from lubricating oil, means connecting each blow-by passage to said separating chamber, and means connecting said separating chamber to said engine intake system.

2. A blow-by gas recovering system for an internal combustion engine, the engine having a crankshaft and having a pan for lubricating oil secured below a crankcase to define a crank chamber, the improvement comprising, in combination: a series of journals provided in the crankcase for contact with the crankshaft, a first blow-by gas outlet at one of said journals communicating with said crank chamber, a second blow-by gas outlet at another of said journals communicating with said crank chamber, said blow-by gas outlets being spaced longitudinally of the engine crankshaft, a separating chamber for separating blow-by gas from lubricating oil, means connecting each blow-by passage to said separating chamber, and means connecting said separating chamber to said engine intake system.

3. The blow-by gas recovering system of claim 1 wherein said first blow-by gas outlet is provided in the pan.

4. The blow-by gas recovering system of claim 3 wherein the said second blow-by gas outlet is provided in the engine block and said separating chamber is mounted on the engine block in direct communication with said second blow-by gas outlet.

* * * * *